United States Patent [19]

Dillon

[11] 3,969,966

[45] July 20, 1976

[54] APPARATUS FOR SLICING MEAT PRODUCTS

[75] Inventor: Oscar W. Dillon, Essex, Conn.

[73] Assignee: Cashin Systems Corporation, Williston Park, N.Y.

[22] Filed: June 9, 1975

[21] Appl. No.: 584,950

[52] U.S. Cl. ..... 83/340; 83/342; 83/672

[51] Int. Cl.[2] ..... B26D 1/28; B26D 1/56; B26D 4/42

[58] Field of Search ..... 83/37, 42, 56, 327, 83/340, 342, 672

[56] References Cited

UNITED STATES PATENTS

| | | | |
|---|---|---|---|
| 1,960,517 | 5/1934 | Taylor | 83/340 X |
| 1,973,526 | 9/1934 | Diamond et al. | 83/340 X |
| 3,777,600 | 12/1973 | Long et al. | 83/340 X |
| 3,799,013 | 3/1974 | Long et al. | 83/56 |

*Primary Examiner*—Willie G. Abercrombie
*Attorney, Agent, or Firm*—Kane, Dalsimer, Kane, Sullivan and Kurucz

[57] ABSTRACT

An apparatus for slicing a meat product in which the cutting edge of a rotating involute slicing blade is advanced in synchronism with the feed of the meat product during the cutting of a slice from the meat product. There is also means for either mounting an involute slicing blade or arranging the cutting edge of an involute slicing blade.

2 Claims, 11 Drawing Figures

APPARATUS FOR SLICING MEAT PRODUCTS

BACKGROUND OF THE INVENTION

In a conventional slicing operation the slicing blade, which has an eccentric involute cutting edge, is continuously rotated and the product to be sliced is fed continuously into the knife. Due to the eccentric involute curvature of the cutting edge each rotation of the blade produces one slice of the product.

If the blade is pushed into the meat product to initiate the cutting of the slice there is a moisture and grease buildup on succeeding slices. Furthermore, the compression of the product when the meat is pushed into the blade causes a power overload.

To overcome these difficulties and prevent the product from running into the back of the blade it has been the practice to cut one slice while the feed of the product is stopped and then advance the product for the next slice. The disadvantage of this practice is that at high speed slicing, for example 1600 slices per minute, it would be impossible to start and stop the meat feed for each slice.

The method of the present invention overcomes the aforementioned disadvantages by advancing the leading edge of the blade at the rate of speed of feed of the meat product to the blade so that there is zero velocity between the blade and the meat. The apparatus of the present invention permits the use of a conventional cutting blade to accomplish this method. In such apparatus the angle of the blade is so set that the cutting edge advances at approximately the same rate as the product. Feeding the meat product into the blade with the blade rotating at such angle prevents the meat from running into the blade while it is cutting. Thus the present invention avoids moisture and grease buildup on the slices, does not cause any noticeable power overload, and permits cutting at high speeds.

SUMMARY OF THE INVENTION

It is an object of the invention to provide an apparatus for slicing a meat product in which the cutting edge of the slicing blade is advanced at the rate of speed of the feed of the meat product into the blade.

It is a further object to provide apparatus for mounting a conventional slicing blade to carry out such method.

It is a further object to provide an assembly which can be arranged so that the cutting edge of an involute slicing blade will carry out such method.

It is a further object to provide one simple and inexpensive change in the blade mounting to carry out a method which is efficient and well suited to accomplish its intended purpose.

BRIEF DESCRIPTION OF THE DRAWINGS

Other objects and advantages will become apparent from the following description which is to be taken in conjuction with the accompanying drawings, in which.

DESCRIPTION OF THE PREFERRED EMBODIMENT

Figure 7:
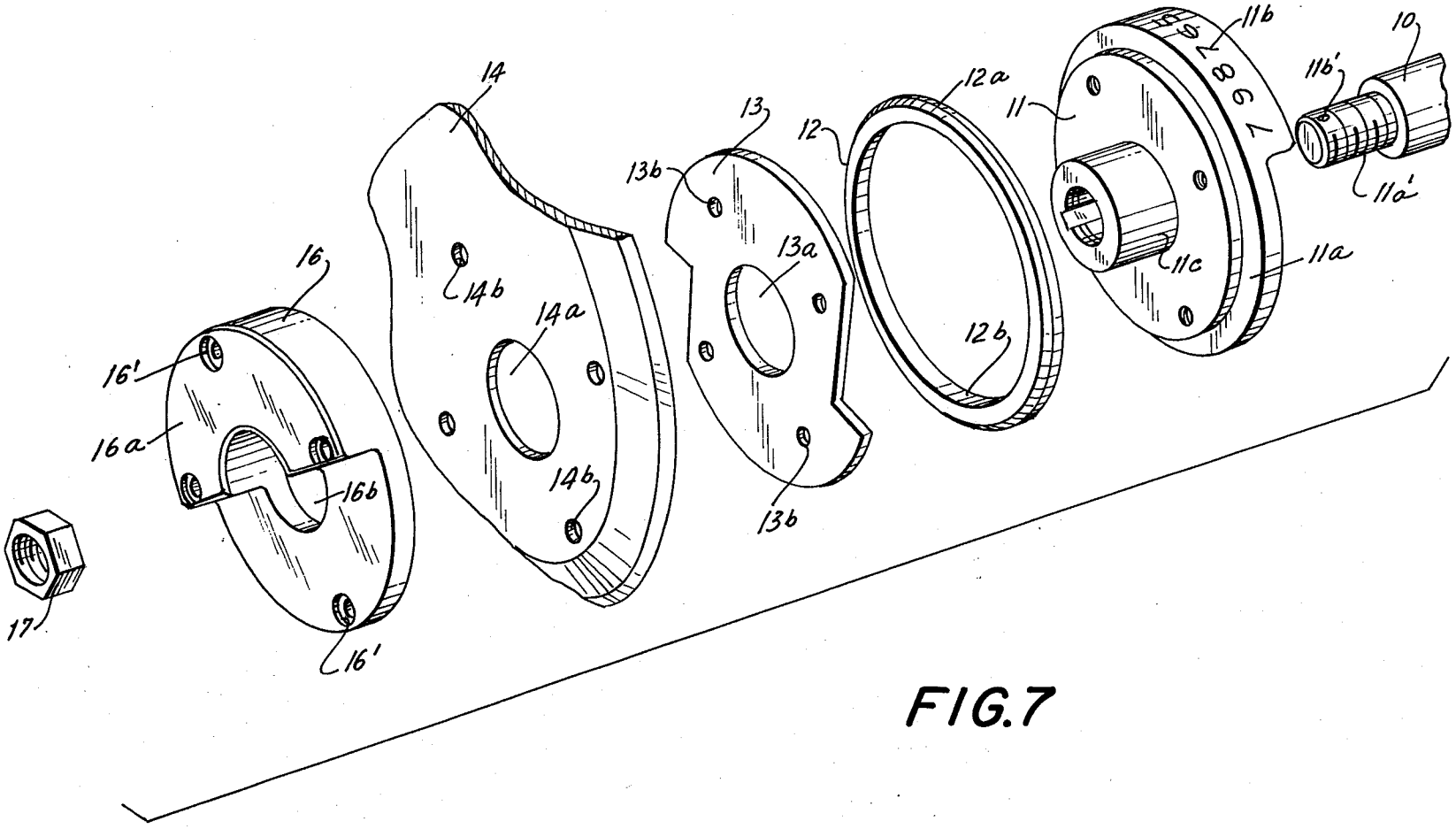
FIG. 7 is a perspective view showing the various components for mounting the blade on the end of the blade shaft.

Referring to the drawings, there are shown in FIG. 7 the various elements of the mounting of the present invention for attaching the slicing blade on the end of the shaft 10 of a conventional slicing machine. Such elements are as follows:

a. Knife bushing 11 which slips over the shaft 10 and is provided with a circular depression **11*a* around the outer edge to receive the wobble ring 12. There are ring phase settings 11*b* around the outer rim of the knife bushing 11 so that the position of the wobble ring 12 on the bushing 11 can be varied. There is also a hub 11*c*** which will receive the other elements hereinafter described.

b. Wobble ring 12 which varies in thickness around its circumference from its narrowest portion **12*a* to its widest portion 12*b*. The inner circumference is sized to fit into the circular depression 11*a* of the knife bushing 11.**

c. Spacer plate 13 which is conventional and is only necessary for some blades to provide clearance for the heel of the knife. Its center opening **13*a* fits over the hub 11*c*** of the knife bushing.

d. Slicing blade 14 which is likewise conventional. It is an eccentric involute disc or dished blade which is adapted to be continuously rotated at relatively high speeds. Although both types of blades perform satisfactorily the dished blade is somewhat preferred for most slicing operations. The portion of the blade having the greatest radius serves to slice the leading edge of the product 15 while the portion of the blade having the minimum radius provides clearance for the product to be fed outwardly thereby permitting the next slicing operation. The hole **14*a* in the blade fits over the hub 11*a*** of the knife bushing.

e. Counter balance 16 which is likewise conventional. It is weighted on one side **16*a* and provided with a hole 16*b* which fits over the hub 11*a*** of the knife bushing.

f. Nut 17 which is screwed to the threaded end **10*a* of the shaft 10.**

Figure 5:
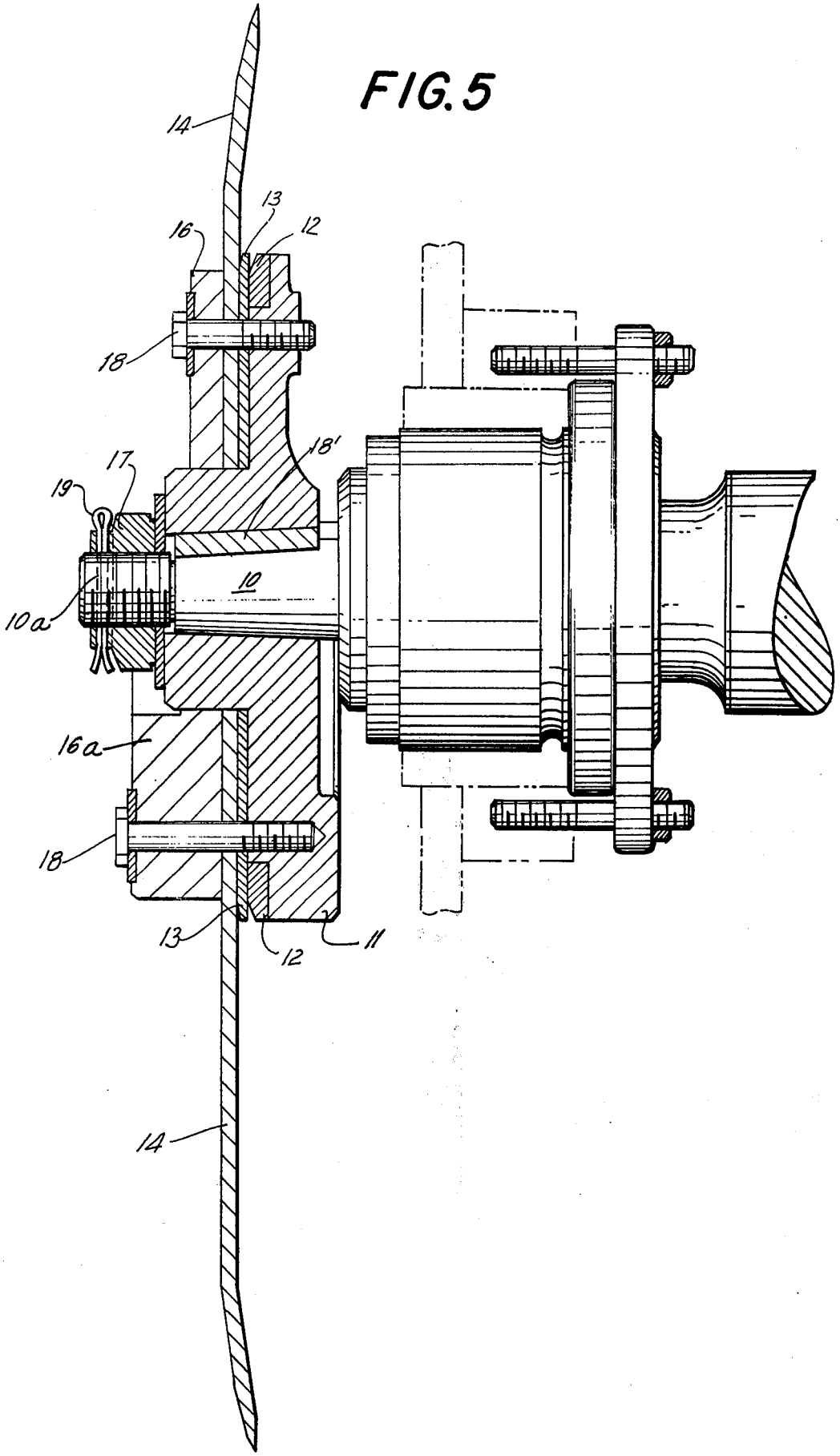
FIG. 5 is a side elevation of the mounting for the slicing blade, partly in section, showing the various components for mounting the blade on the end of the blade shaft with the cutting edge of the blade about normal to the shaft, such as the position it would be in when the cutting of a slice is completed, as shown in FIGS. 4A–4B.

It will be seen in FIG. 5 that the various elements above described are secured together by screws 18 which pass through holes **16*c* in the counter balance 16, 14*b* in the slicing blade 14, and 13*b* in the spacer plate 13 into threaded holes 11***d* in the knife bushing 11. The knife bushing 11 is secured to the shaft 10 by a key 19 in slots in the bushing and shaft. The nut 17, which is screwed to the threaded end 11*a* of the shaft 10, is held against release by a cotter pin 19 passing through a hole 11*b* in such end.

Figure 6:
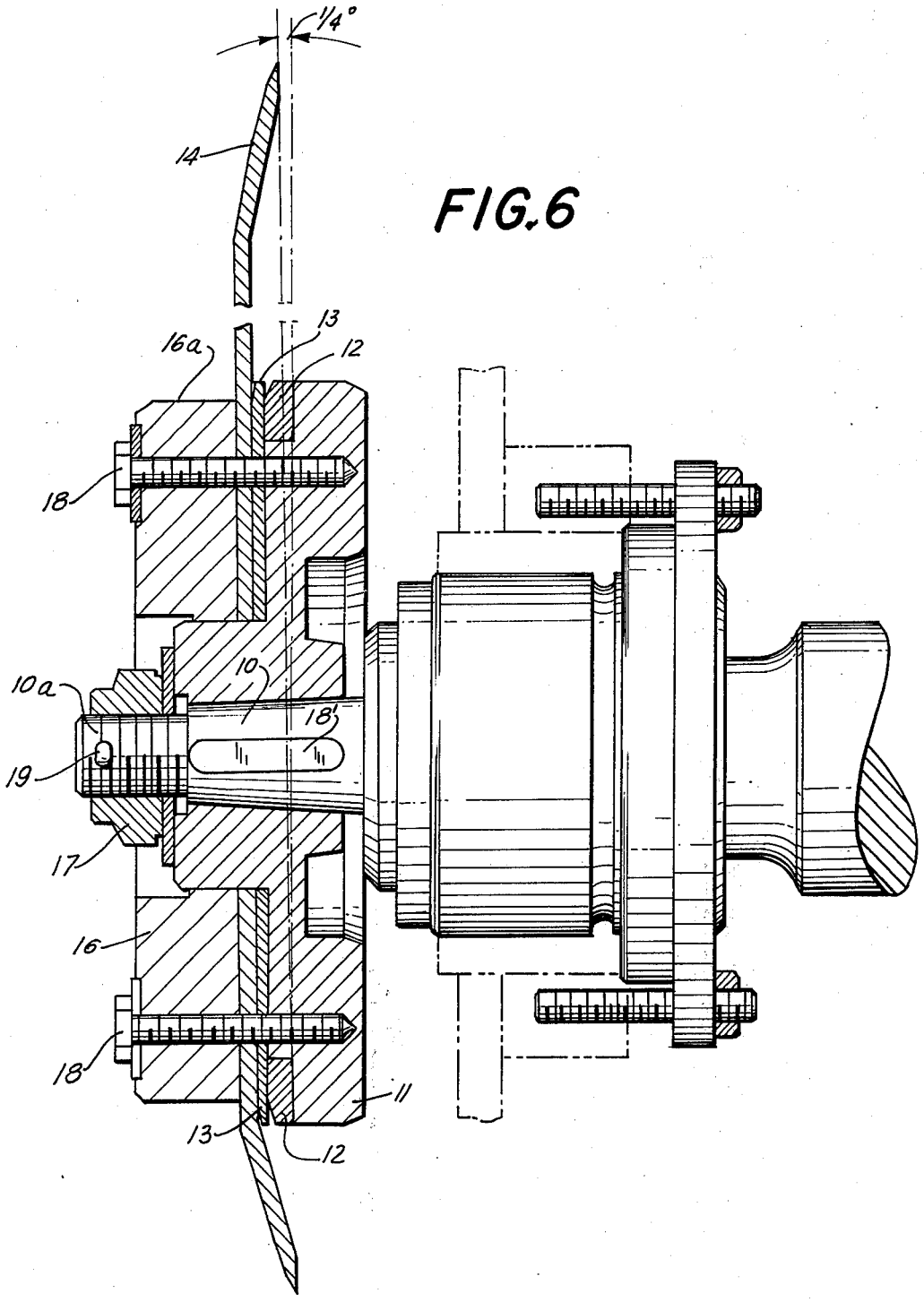
FIG. 6 is a view similar to that of FIG. 5 with the cutting edge of the blade retracted at a slight angle from the normal to the shaft, such as the position it would be in when beginning the cutting as shown in FIGS. 1A–1B.

The remainder of the shaft mounting shown in FIGS. 5 and 6 is conventional, does not form any part of the present invention, and need not be described herein.

Figure 1A:
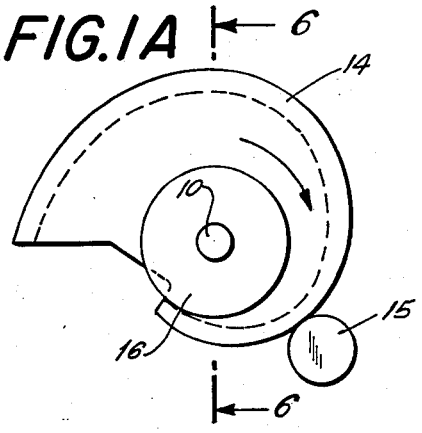
FIG. 1A is a side view of a conventional eccentric involute slicing blade in the mounting of the present invention making its first cutting contact with the loaf of meat product.
Figure 1B:
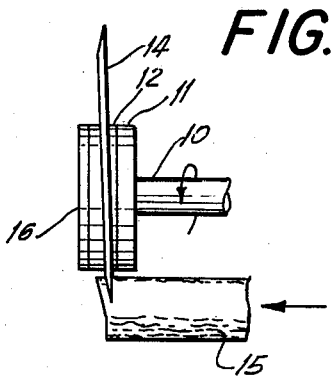
FIG. 1B is an edge view of the blade and meat product of FIG. 1A.
Figure 2A:
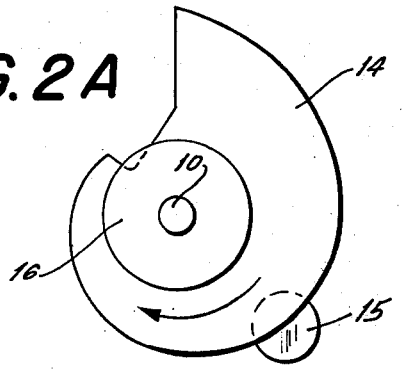
FIGS. 2A–2B and FIGS. 3A–3B are similar to those of FIGS. 1A–1B showing the cutting edge and meat product further advanced in cutting the slice of product.
Figure 2B:
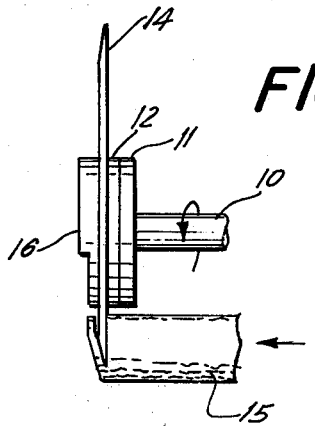
Figure 3A:
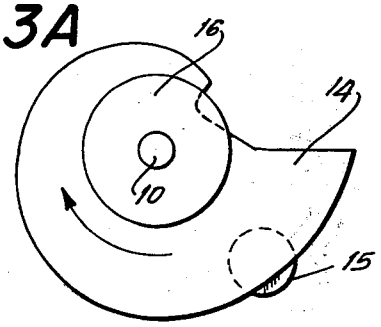
Figure 3B:
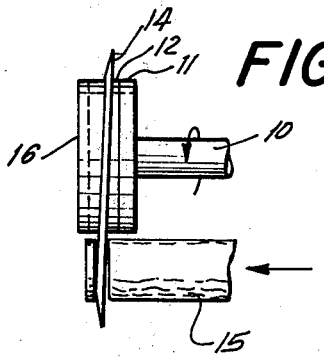
Figure 4A:
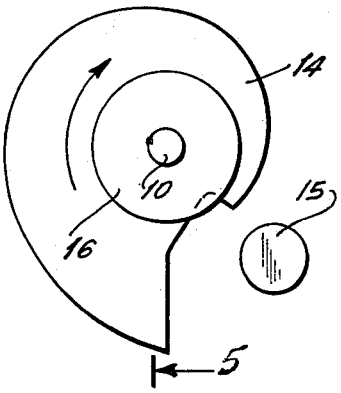
FIGS. 4A–4B are similar views showing the slice completed and the cutting edge retracting from its most advanced position preparatory to beginning the cutting of the next slice as shown in FIGS. 1A–1B.
Figure 4B:
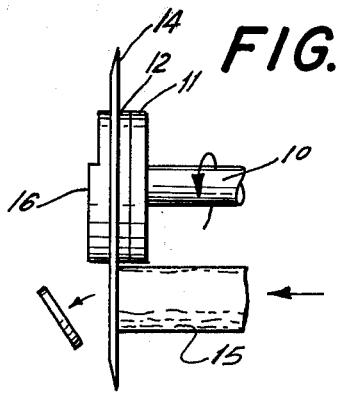

The operation of the slicing blade, shown as dished, in cutting slices of meat product in accordance with the present invention should be apparent from the drawings (FIGS. 1A to 4B, inclusive) and the foregoing description. The rotating blade initially makes contact with the meat product as the blade moves from its narrowest radius to a greater radius and cuts into the meat product (FIGS. 1A–1B). At this stage the bottom of the blade is retracted to its backmost position at an angle to a plane substantially parallel to the transverse axis of the path of feed of the product (FIG. 1B). As the rotating blade cuts into the meat product (FIG. 2A) both the cutting edge and the product have moved in the direction of the feed to the position shown in FIG. 2B. It will be seen that a portion of the loaf of the meat product is within the dished portion of the blade. At this stage the blade is in a plane substantially parallel to the transverse axis of the path of feed of the product. Further rotation of the blade and forward movement of the product brings the cutting edge of the blade and the product further in the direction of the feed to the position shown in FIG. 3A. At this stage the slice is virtually completely severed and the blade is in its foremost position at an angle to a plane substantially parallel to the transverse axis of the path of feed of the product (FIG. 3B). When the slice of meat has been cut through, it is completely within the dished portion of the blade. When the blade no longer contacts the product as shown in FIG. 4A, the cutting edge of the blade has begun to retract and again is in a plane substantially parallel to the transverse axis of the path of feed of the product (FIG. 4B). When the cutting edge of the blade has been completely retracted it is ready to start cutting another slice as shown in FIGS. 1A–1B. It will be seen that the blade is cutting over more than 180° of rotation.

The angle of the slicing blade can be varied depending on the thickness of the slice to be cut from the meat product. As an example, if a slice one-eighth of an inch is to be cut from the loaf, such loaf will be advancing one-sixteenth of an inch for each 180° rotation of the blade and one-eighth of an inch for each 360° rotation of the blade. To accomplish this one-eighth inch cutting the angle of the blade with relation to a plane substantially parallel to the transverse axis of the feed of the product will be one-quarter of a degree. Upon rotation of the blade such angle will bring the cutting edge successively from one side of such plane to the other side of said plane.

Thus, the several aforenoted objects and advantages are most effectively attained. Although several somewhat preferred embodiments of the invention have been disclosed and described in detail herein, it should be understood that this invention is in no sense limited thereby and its scope is to be determined by that of the appended claims.

Having thus described the invention, what is claimed is:

1. A rotary cutting blade assembly for slicing a product as it is fed into the path of the cutting edge of the blade in the direction of its longitudinal axis, said assembly comprising:

a flat metal blade having a sharpened cutting edge of varying radii from the center of the blade to define a generally involute configuration around the periphery thereof graduated between a first portion positioned relatively close to said center and a second portion spaced a greater distance from the said center so that when the product is fed into the blade as the blade is rotated a slice is cut for each rotation of the blade;

a shaft for rotating the said blade;

means to mount the said blade on the said shaft for rotation in a direction generally transverse of the path of the feed of the product, said mounting means being located adjacent the evolute center of the blade from which the involute configuration is generated, said mounting means including a flat portion normal to the said shaft; and a ring graduated in thickness from a first arc of the circumference to a greater thickness at a second arc of the circumference opposite the said first arc, the said ring being inserted between the said flat portion of the mounting means and the said blade to position the said blade at an angle to the axis of rotation, the said ring being rotatable with respect to the blade whereby the said first arc can be adjusted to any desired radius of the blade.

2. The assembly of claim 1 wherein the angle of the blade with respect to its axis of rotation will be one-quarter of a degree.

* * * * *